United States Patent [19]

Wallace

[11] Patent Number: 4,620,375

[45] Date of Patent: Nov. 4, 1986

[54] SNOWSHOE BINDING AND ICE CRAMPON OR THE LIKE

[76] Inventor: Robert E. Wallace, 12881 Foothill La., Saratoga, Calif. 95070

[21] Appl. No.: 627,316

[22] Filed: Jul. 2, 1984

[51] Int. Cl.[4] ..... A43C 15/06; A63C 13/00; A63B 29/00

[52] U.S. Cl. ..... 36/7.6; 36/7.5; 36/125

[58] Field of Search ..... 36/122–125, 36/7.6, 7.7, 114, 7.5

[56] References Cited

U.S. PATENT DOCUMENTS

| | | | |
|---|---|---|---|
| 1,386,028 | 8/1921 | Roe | 36/7.6 |
| 1,487,390 | 3/1924 | King | 36/7.6 |
| 1,837,730 | 12/1931 | Smith | 36/7.6 |
| 2,738,596 | 3/1956 | Walsh | 36/124 |
| 2,807,098 | 9/1957 | Wunker | 36/7.6 |
| 3,685,173 | 8/1972 | Piazza | 36/7.6 |
| 4,351,121 | 9/1982 | Wallace | 36/125 |
| 4,480,396 | 11/1984 | Lowe et al. | 36/7.6 |

FOREIGN PATENT DOCUMENTS

| | | | |
|---|---|---|---|
| 2264044 | 7/1974 | Fed. Rep. of Germany | 36/7.6 |
| 2106932 | 5/1972 | France | 36/7.6 |

*Primary Examiner*—James Kee Chi

*Attorney, Agent, or Firm*—Allston L. Jones

[57] ABSTRACT

A quick-lock-quick-release device for attaching a boot to a foot plate which doubles as an ice crampon or mounting plate for an alloy snowshoe is provided. The lock-release foot plate design is such that it can readily be adjusted for any size of boot by simply moving the lock-release lever on the foot plate. This design also lends itself to the use of the Arctic vapor barrier boots used by the military. In addition, three crampon designs are included as well as a quick release mechanism for attachment/detachment of the foot plate to/from the snowshoe without the necessity of tools. An articulated foot plate for use with an alloy snowshoe for running in snow is also shown. The articulated foot plate consists of two pieces, a toe portion and a heel portion, which are hinged together around the pivot pin to allow for flexing of the sole of the wearer's shoe during running.

12 Claims, 23 Drawing Figures

SNOWSHOE BINDING AND ICE CRAMPON OR THE LIKE

CROSS-REFERENCE TO RELATED PATENT

This application is related to U.S. Pat. No. 4,351,121 entitled "SNOWSHOE" issued Sept. 28, 1982 to the same inventor as the present application.

BACKGROUND OF THE INVENTION

The older, more typical designs of snowshoes utilize wood frames with leather strips for webbing with the boot attached to the snowshoe with a complicated binding arrangement of thongs, buckles and straps. Because of the snowshoe shape and loose bindings, these prior designs provide inadequate control over movement of the snowshoe and hence are very difficult to maneuver. Also the materials used required frequent care and upkeep. For example, the wood frames and leather webbing require frequent varnishing to repair abrasive wear and, particularly, stretching of the leather components due to the absorption of water. Some more recent designs incorporate synthetic materials for webbing but have similar problems.

Of particular annoyance to snowshoe users has been the fact that these prior art designs required the use of the bare hands to manipulate the complicated plastic or leather bindings used to attach the boots to the snowshoes. The problem is aggravated at low temperatures and could be injurious to the user.

The above-referenced patent discloses an improved one-piece snowshoe and crampon/binding assembly. The binding assembly therein disclosed is a quick-lock-quick-release mechanism which is adjustable to accommodate any size boot. In that design the retaining bands include a screw adjustment of the type such as used with hose clamps which requires the use of a screwdriver to adjust them initially to the size and shape of the wearer's boot. It is desirable to have a quick-release binding which offers the features of the binding of the above-referenced patent without the need of tools for adjustment for different sized boots and attachment of a heel crampon. The present invention meets that goal.

SUMMARY OF THE INVENTION

In accordance with the illustrated embodiments, one embodiment of the present invention provides a quick release snowshoe binding and crampon. The binding includes a foot plate for receiving the sole of a boot, a boot toe-capturing means affixed to the foot plate, and a locking device which captures and applies a forward and downward pressure to the heel portion of the boot. The forward pressure on the heel forces the toe of the boot into the capturing means when the heel is locked to the foot plate, and the downward pressure retains the heel on the foot plate.

The means for capturing the toe of the boot can take either of two forms depending on the construction of the boot. For boots having a welt by which the sole is attached at the toe, the capturing means is a toe clip which is dimensioned to receive the welt. For other boot constructions, the capturing means includes a toe bracket for limiting the forward and lateral displacement of the boot, and a toe band which passes over the top of the toe to restrict the vertical displacement of the toe.

The foot plate includes a side rail along each side in the vicinity of the heel portion with a plurality of uniformly sized holes therein. These side rails prevent lateral movement of the boot heel on the foot plate. The locking devices include a substantially U shaped bail with each end removably captured in a hole in each of the adjacent side rails, and a lever mounted centrally on the bail with an edge of the lever disposed to mate with the rear portion of the boot.

The foot plate further includes a toe crampon having tooth-like projections extending therefrom. Three types of heel crampons are also disclosed. One embodiment includes a plurality of sharpened projections which extended downward from the foot plate. The second embodiment heel crampon is a substantially U shaped channel dimensioned to fit beneath the foot plate with sides that extend upward juxtaposed to the side rails. In the bottom of this channel, sharpened projections have been extended downward therefrom. Additionally, the U shaped heel crampon includes a plurality of holes placed to align with the holes in the side rails to facilitate attachment thereto. The third embodiment heel crampon includes a multiplicity of crampon points which are formed and extend downward from the heel portion of the foot plate.

Another embodiment of the binding assembly provides an articulated foot plate to facilitate running with flexible soled shoes in the snow. The articulated foot plate has a toe portion and a heel portion. The adjacent edges of the two portions are disposed to interleave one with the other to form a hinge.

The foot plate forward portion includes a toe clip which extends upward and rearward from its forward edge to receive the toe portion of the wearer's shoe.

The foot plate heel portion includes the locking means in the form of a strap which is removably affixed thereto. The strap also includes fastener means on at least one end of the strap for, when closed, affixing the heel portion of the wearer's shoe to the foot plate heel portion. There is also a crampon means affixed to the underside of the foot plate toe portion.

The two portions of the foot plate are joined by a pivot pin captured in the hinges of each. The pivot pin also defines the axis around which the foot plate pivots when in use with a snowshoe with bushings therein disposed to receive the pivot pin.

Each of the foot plates attaches to a snowshoe pivotally by means of at least one pin which passes through bushings in the sides of the snowshoe and which is captured by the foot plate. If two pins are used, one is placed through each side bushing and extends into the pivot point of the foot plate.

DESCRIPTION OF THE DRAWINGS

FIG. 11 is a rear end view and FIG. 2 is a side view of the first embodiment of the binding assembly with the second type of heel crampon in place.

DESCRIPTION OF THE PREFERRED EMBODIMENT

Figure 1:
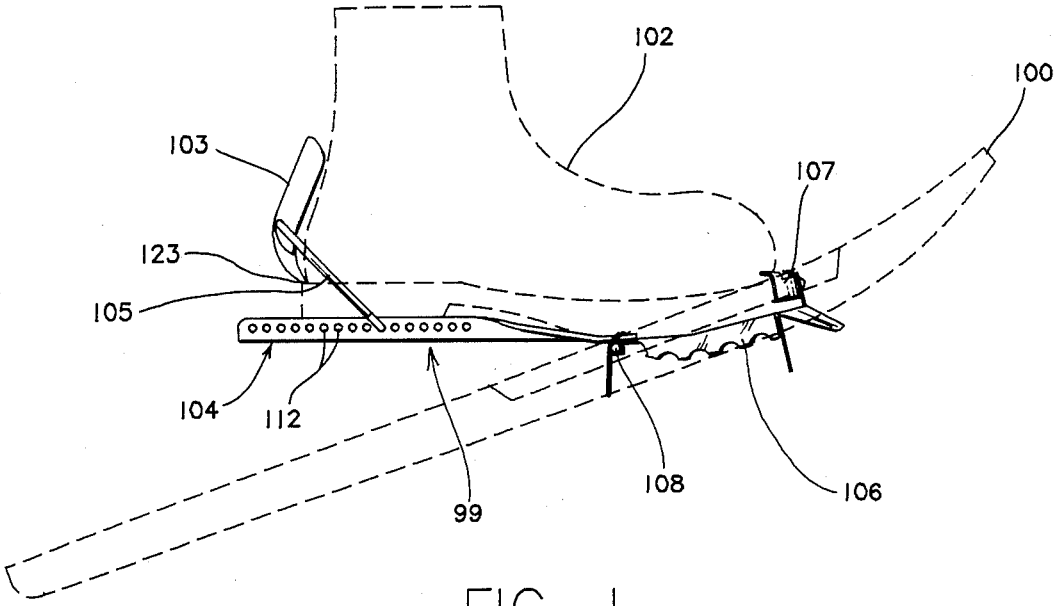
FIG. 1 is a side view showing that first embodiment of the binding assembly attached to the snowshoe as the wearer of the snowshoe takes a step forward.

Referring now to FIG. 1 there is shown, in dotted outline, a snowshoe 100 to which is attached a first embodiment of a binding assembly 99. Snowshoe 100 is of the design disclosed in the above-referenced patent and shown in FIGS. 6 and 7 herein.

Figure 2:
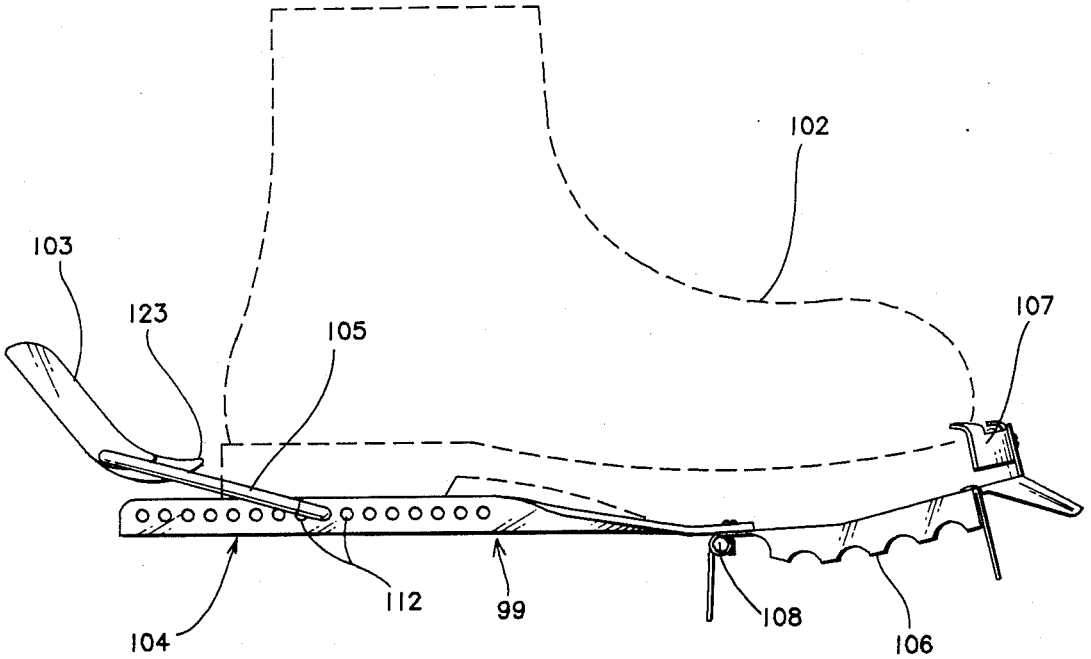
FIG. 2 is a side view of the embodiment of the binding of FIG. 1 with the locking lever in the unlocked position.

Binding assembly 99 includes a foot plate 104 and a crampon 106/toe clip 107 assembly. Foot plate 104 is dimensioned to accommodate the heel and a portion of the sole or boot 102. The remainder of the sole of boot 102 is supported by crampon 106 with toe clip 107 dimensioned to receive the toe welt of the boot. Boot 102 is caprured by binding assembly 99 by raising heel clamp 103 and bail 105 until the lower lip 123 of clamp 103 contacts the top of the heel welt of the boot. As the top edge of clamp 103 is pushed forward, boot 102 is wedged into place between the toe clip 107 and the clamp 103 as shown. To release the boot from the binding assembly 99, the above procedure is reversed. FIG. 2 shows another view of the first embodiment of the binding assembly 99 with boot 102 in place ready for attachment thereto.

Figure 3:
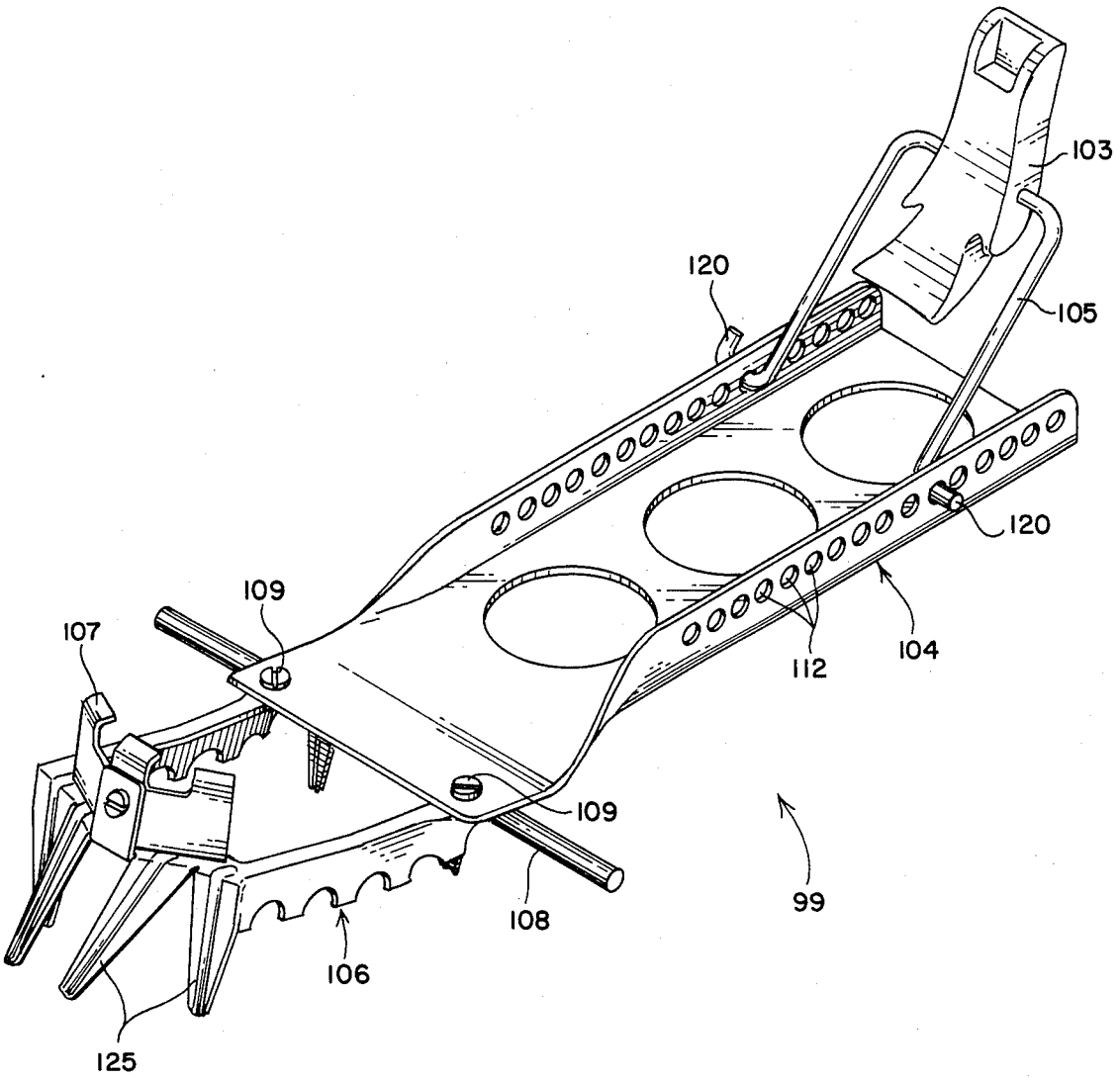
FIG. 3 is a perspective view of the embodiment of the binding of FIG. 1 without a boot in place.
Figure 3A:
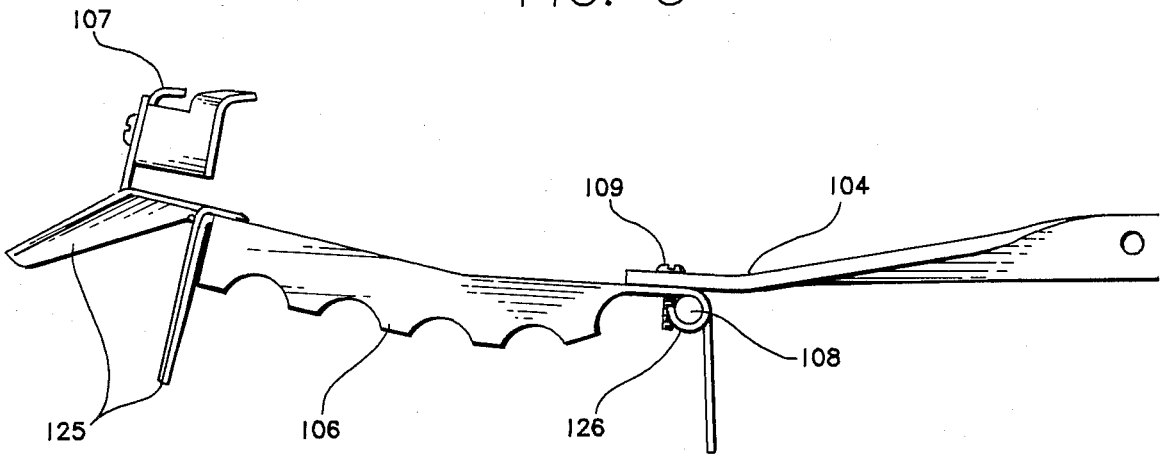
FIG. 3*a* is a partial side view of the toe end of the embodiment of the binding of FIG. 1.
Figure 4:
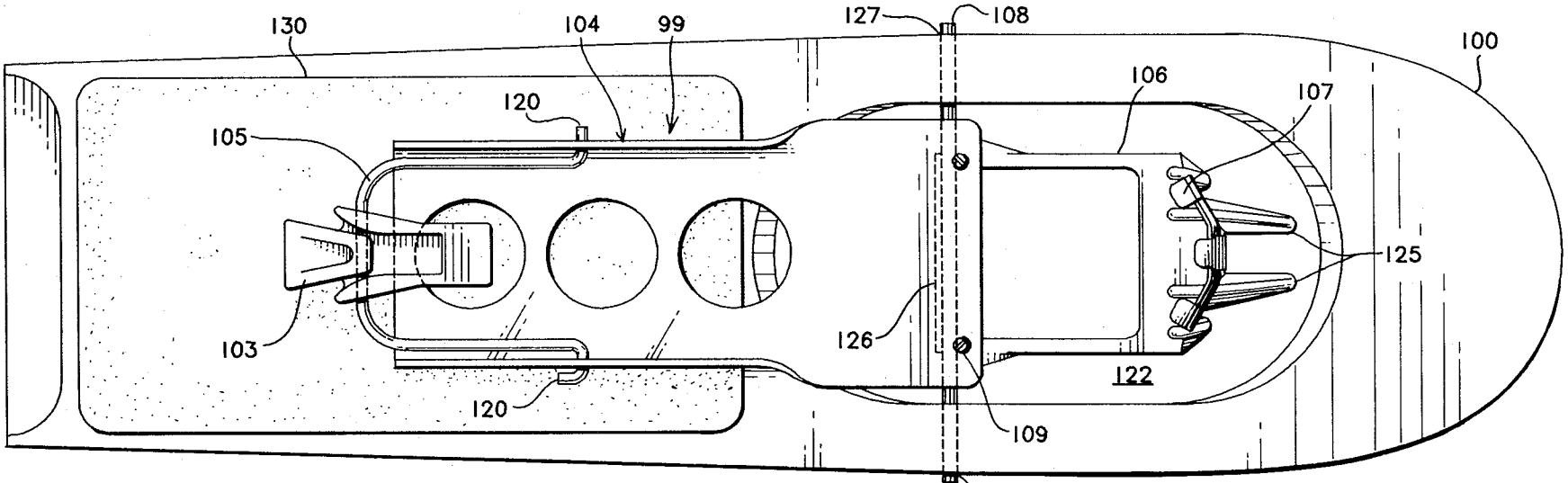
FIG. 4 is a top view of the embodiment of the binding of FIG. 1 on a snowshoe of the type disclosed in the above-referenced patent.

FIGS. 3, 3*a* and 4 provide views of the first embodiment of the binding assembly 99 without boot 102. Here it can be seen that foot plate 104 and crampon 106 are coupled to each other by means of retaining screws 109. Additionally, the threads of retaining screws 109 contact pivot pin 108 to lock it in position. To attach binding assembly 99 to snowshoe 100, pivot pin 108 is inserted through both bushing holes 127 (see FIGS. 4 and 7) of snowshoe 100 and hinge 126 formed along the rearmost edge of crampon 106. Next, foot plate 104 is assembled to crampon 106 with retaining screws 109, as shown, within the toe hole 122 of the snowshoe 100. Lateral motion of the binding 99 is restricted since the sides of foot plate 104 are in close proximity to the inner sides of toe hole 122 (FIG. 4).

Adjustment for different size/types of boots is provided by movable bail 105. To adjust for various lengths of boots, bail ends 120 are squeezed together to free them from adjacent holes 112 in the side rails of foot plate 104. The bail is then repositioned and the ends 120 are released and sprung into the newly selected holes 112. One end of bail 105 may be formed into a hook to minimize the possibility of bail 105 from becoming disengaged when the snowshoe is not in use. For best operation bail 105 should be made of a heavy gauge steel wire. Further, for proper operation and the achievement of a positive lock of a boot in the binding assembly, the ends of bail 105 should be placed in holes 112 which will cause the lower lip 123 of heel clamp 103 to be below bail 105 and behind its ends 120 when the boot is locked in place as shown in FIG. 1.

Figure 5:
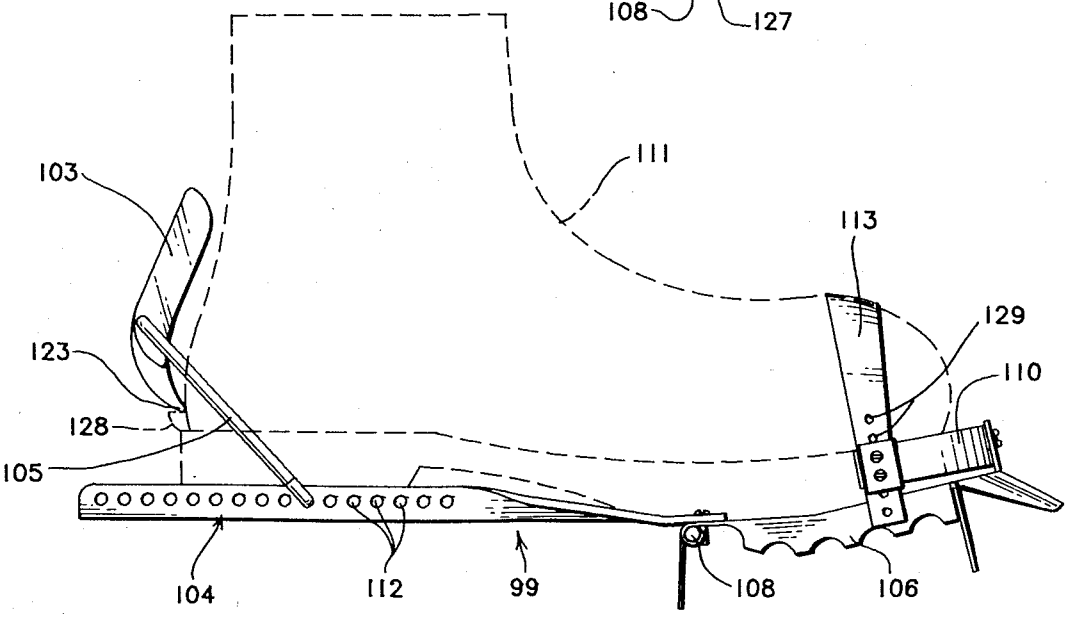
FIG. 5 is a side view of the second embodiment of the binding assembly and boot in the locked position.

FIG. 5 shows a second embodiment of the binding assembly 99. This embodiment is a modification of the first to accommodate boots which do not have a toe welt and boots (such as the military vapor barrier boot for use in arctic type environments) which are subject to puncture and abrasion at points of metal contact. For those types of boots, toe clip 107 is replaced with a toe bracket 110 and a toe band 113. As shown, the toe of boot 111 is inserted against toe bracket 110 and plastic toe band 113 encircles the toe end of boot 111 by passing over the top thereof. To lock such a boot into binding assembly 99, the lower lip 123 of heel clamp 103 is locked onto rear shelf 128 of boot 111 in the same manner as with boots having a welt type construction. Adjustment holes 129 in toe band 113 are provided to accommodate boots of differing toe dimensions.

Figure 8:
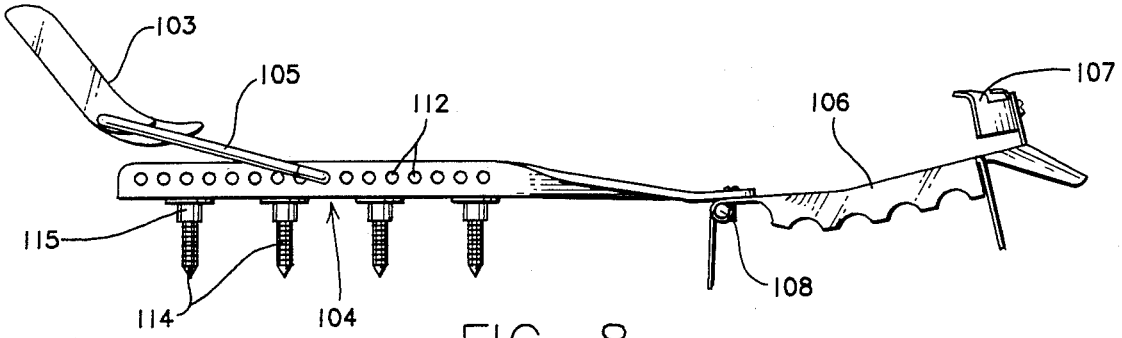
FIG. 8 is a side view and FIG. 9 is a top view of a third embodiment binding assembly of the present invention incorporating a first type heel crampon.
Figure 9:
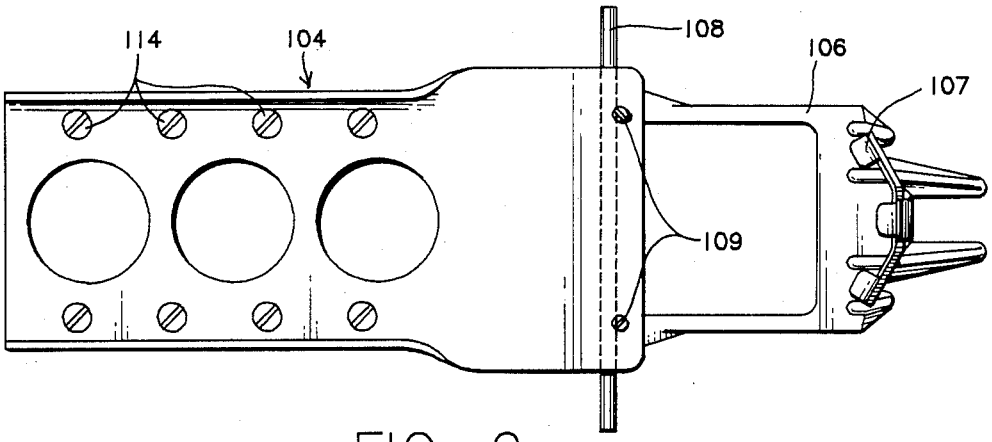

FIGS. 8–12 and 20 show three embodiments of heel crampons for use with foot plate 104 when binding assembly 99 is separated from snowshoe 100. FIGS. 8 and 9 show an embodiment wherein the heel crampons are permanently affixed to foot plate 104. As shown, the heel crampon consists of pins or screws 114 with sharpened tips that extend through foot plate 104 and are affixed thereto by "T" nuts 115 or other means.

Figure 10:
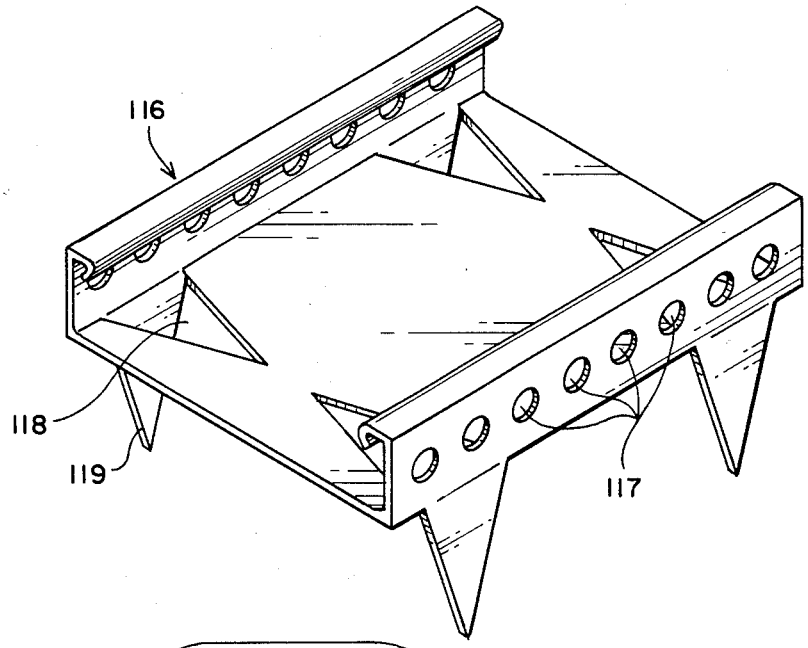
FIG. 10 is a perspective view of a second type heel crampon of the present invention.
Figure 11:
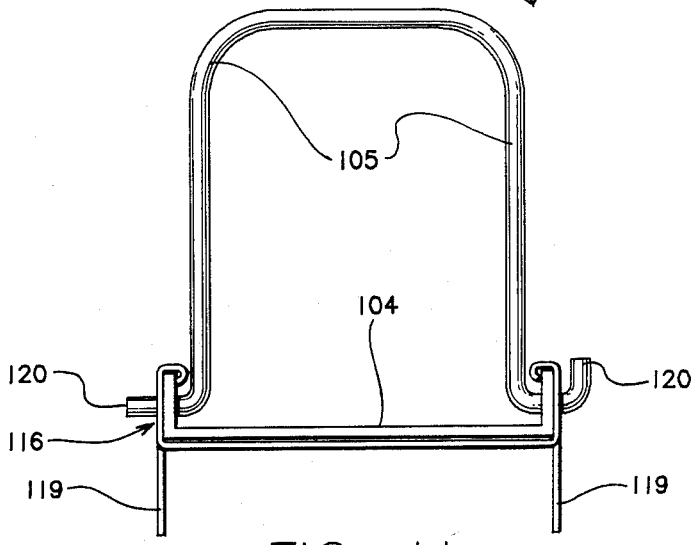
Figure 12:
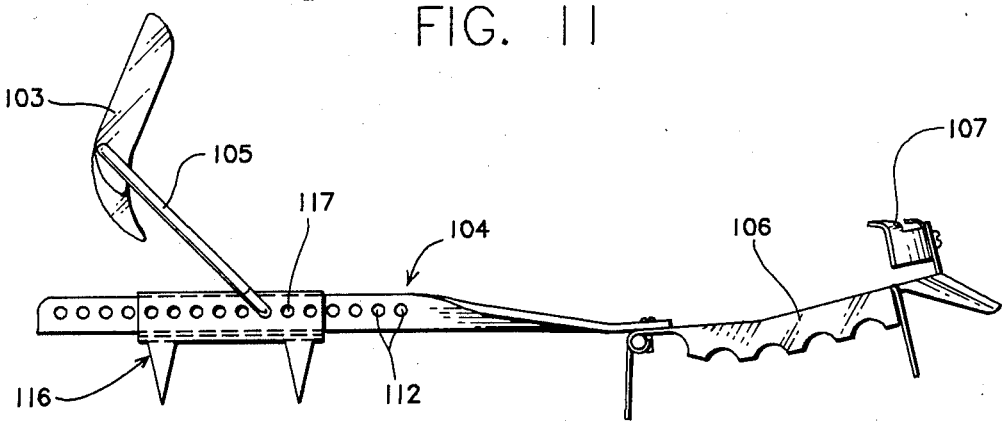

The second heel crampon embodiment is shown in FIGS. 10–12. It consists of heel crampon 116 formed preferably of a metal material and sized to slip onto the rear end of foot plate 104. Heel crampon 116 is shaped in the form of a modified "U" with smaller channels along the upper edges of either side to couple with the top edge of the two side rails of foot plate 104. Crampon 116 includes attachment holes 117 which are spaced to align with adjustment holes 112 in foot plate 104, and teeth or points 119 which may be cut and formed from the bottom surface of heel crampon 116. Heel crampon 116 is shown attached to foot plate 104 by means of the ends 120 of bail 105 which pass through selected holes 112 and 117 in the foot plate 104 and heel crampon 116, respectively. Alternatively, heel crampon 116 could be affixed to foot plate 104 by means of screws passing through holes 112 and 117 which are not necessary for the proper positioning of bail 105. If this attachment method is used, heel crampon 116 will not need the smaller upper channels along its top edges. In either form, crampon 116 can be formed from a flat sheet of a suitable metal material.

Figure 20A:
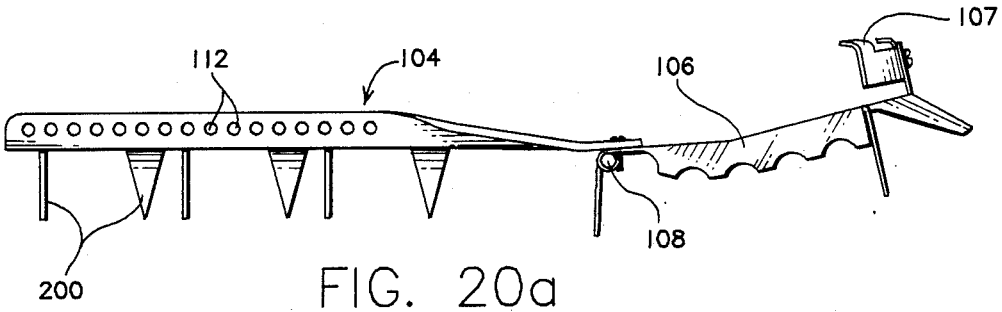
FIG. 20*a* is a side view and FIG. 20*b* is a top view of a binding assembly of the present invention incorporating a third type heel crampon.
Figure 20B:
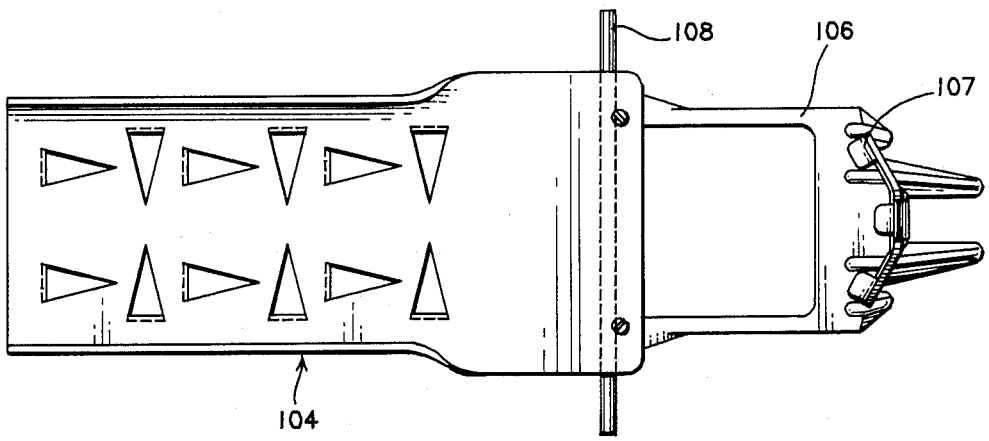

The third crampon embodiment is shown in FIGS. 20*a* and 20*b*. In this embodiment a multiplicity of crampon points 200 are formed from the flat heel portion of foot plate 104 and extend downward therefrom.

Referring again to FIG. 6, snowshoe 100 is shown having appropriate mating holes 121 to accommodate the heel crampon points of foot plate 104 if the heel crampon is in place while using the snowshoe. In addition, a sound absorbing pad 130 (see FIG. 4) is affixed to the top surface of snowshoe 100 beneath foot plate 104. Pad 130 is provided to absorb or dampen vibrations produced when foot plate 104 contacts snowshoe 100 when in use.

Figure 13:
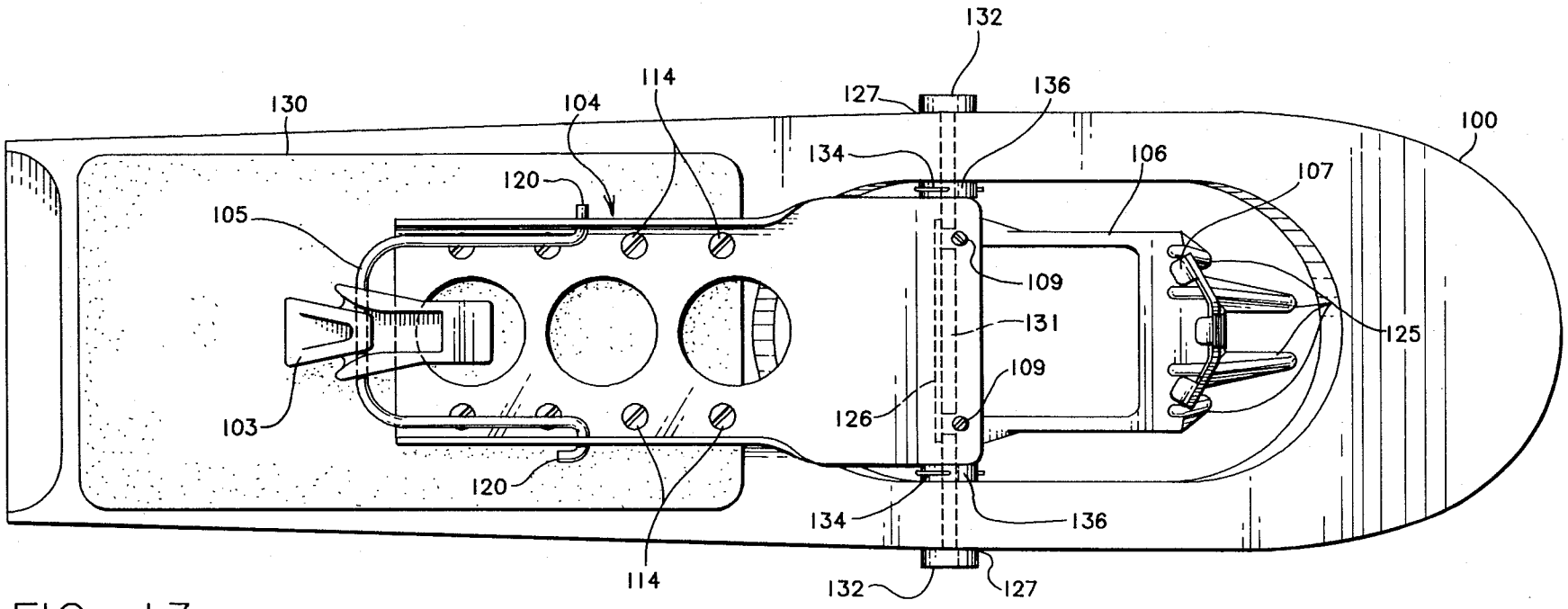
FIG. 13 is a top view of the snowshoe/foot plate assembly designed for the removable mounting of a combined foot plate/crampon to a snowshoe of the type disclosed in the above-referenced patent.
Figure 14:
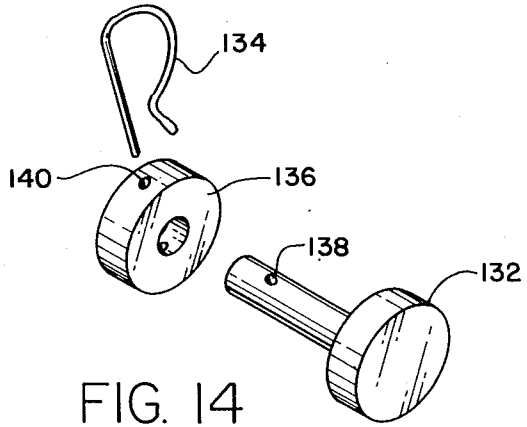
FIG. 14 is an exploded perspective view of the removable pin, spacer and retaining clip of the embodiment shown in FIG. 13.
Figure 15:
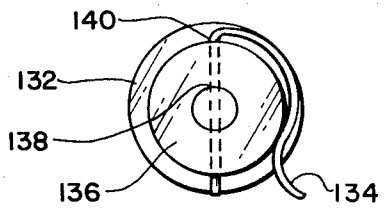
FIG. 15 is an assembled end view of the removable pin, spacer and retaining clip of the embodiment shown in FIG. 13.

A quick release mounting system for foot plate 104 is shown in FIGS. 13–15. Such a system is useful in a situation where the surface conditions change from snow to ice or the opposite. The system shown here allows the wearer to remove or attach the foot plate/-crampon assembly from or to snowshoe 100. The foot plate quick release system includes a removable pin 132, the shaft of which extends through bushing hole 127 on either side of snowshoe 100, through the center hole of spacer 136 and into hinge 126 in foot plate 104 stopping just short of screw 109, adjacent to fixed center pin 131. Any of various means could be employed to retain removable pins 132 as shown in FIG. 13 including a keeper, a tight fitting spacer 136, or a spring finger which can be positioned over the head of pin 132. In FIGS. 14 and 15 a spring retaining clip 134 is used. When pin 132 is inserted into snow shoe 100, the lateral hole 138 through its shaft is aligned with the lateral hole 140 in spacer 136. The straight portion of retaining clip 134 is then passed through lateral holes 138 and 140 with the arcuate portion of clip 134 snapping into place around spacer 136. To remove foot plate 104 from snowshoe 100, the above procedure is reversed.

The sport of snow running has been growing rapidly in the past few years and in order to run in the snow standard snowshoes have been used with standard running shoes. Whether the runner is running on pavement, dirt or snow a shoe with a flexible sole is necessary.

Figure 6:
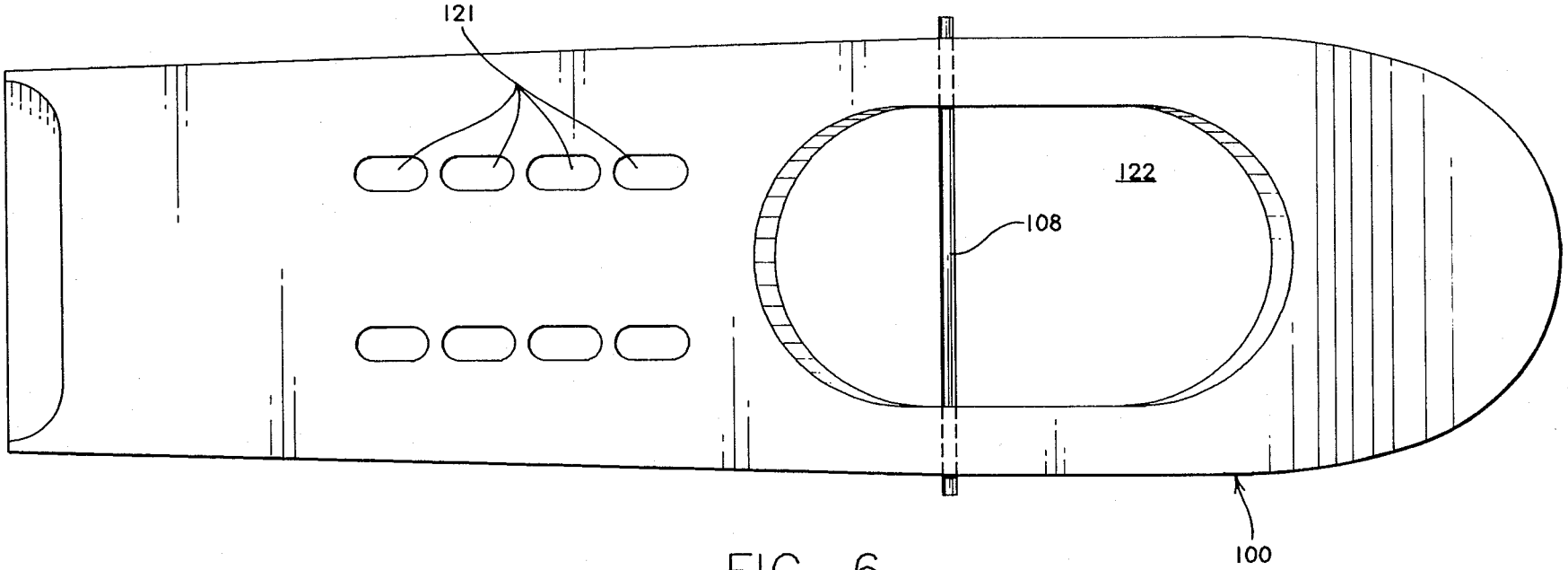
FIG. 6 is a top view and FIG. 7 is a side view of the snowshoe of the above-referenced patent without the binding.
Figure 7:
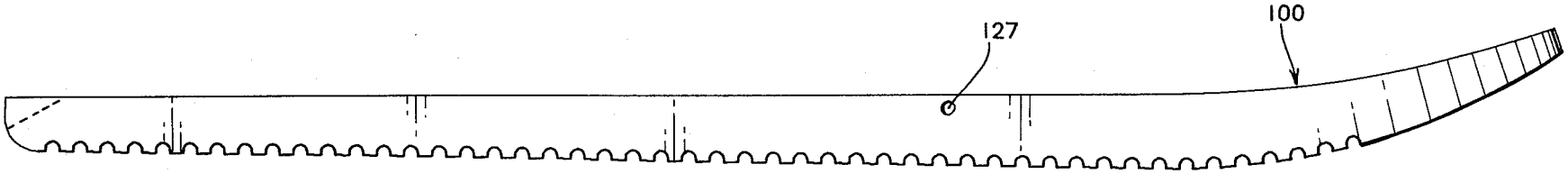

In order to allow a runner to run in a snowshoe like the one shown in FIGS. 6 and 7, that snowshoe must be equipped with an articulated foot plate. FIGS. 16–19 illustrate such a foot plate 150. It can be seen that articulated foot plate 150 includes a toe portion 152, a heel portion 154, and a foot strap and fastener 166–170.

Toe portion 152 also includes a toe clip 156 which extends upward and toward the back from the front end thereof and a toe crampon 158 extending downward from the front end of toe portion 152. Toe crampon 158 is shown as being affixed by means of a nut and bolt 160, however, any other type of fastener could be used in their stead. Toe clip 156 is designed to extend above the soft toe end of the running shoe of the runner to hold down the toe end while running.

Figure 16:
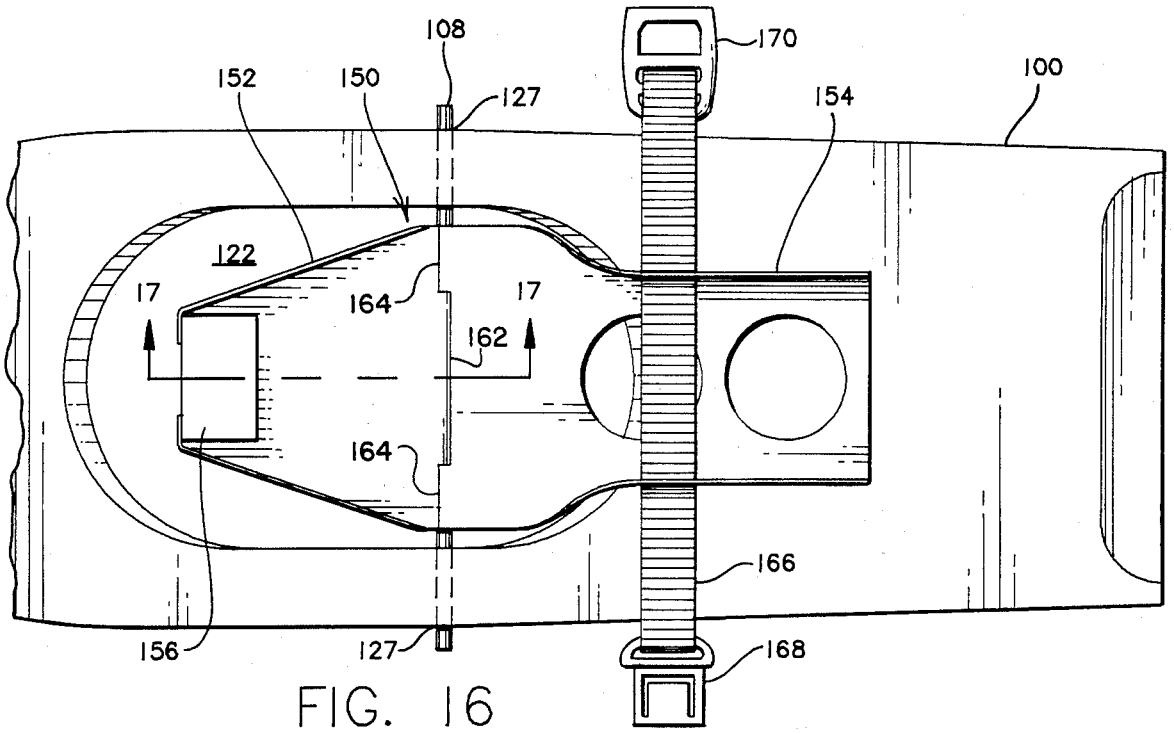
FIG. 16 is a top view of a third embodiment of the binding assembly attached to the snowshoe which is shown partially cut-away.
Figure 17:
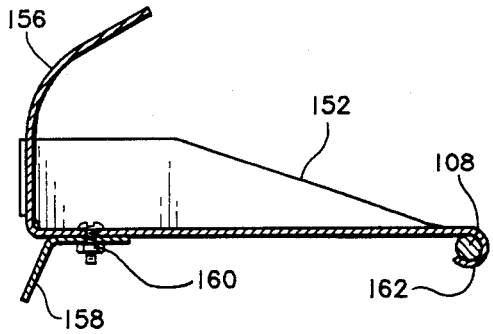
FIG. 17 is a cross-sectional view along line 17—17 of the toe portion of the binding assembly of FIG. 16 without the snowshoe.
Figure 18:
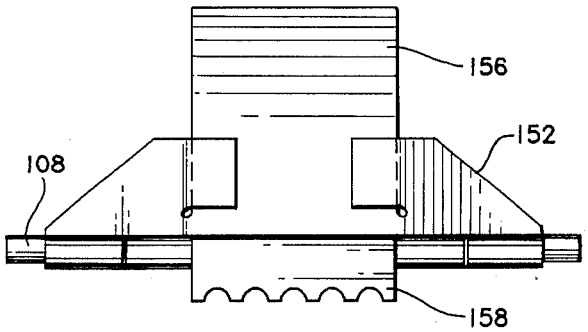
FIG. 18 is a frontal view of the binding assembly of FIG. 16 without the snowshoe.
Figure 19A:
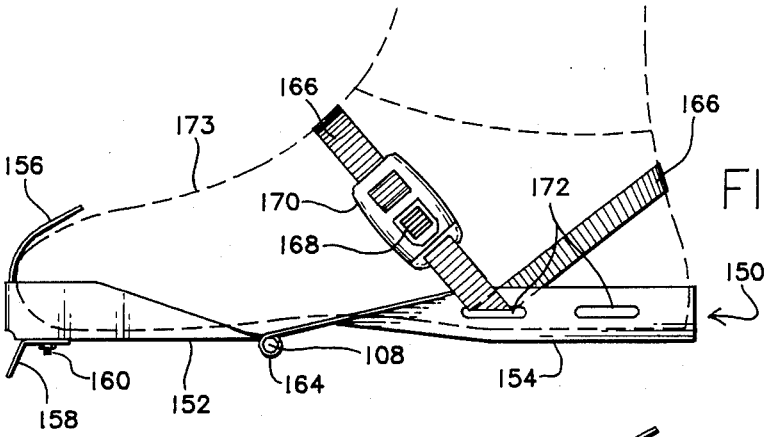
FIGS. 19*a* and 19*b* are side views of the binding assembly of FIG. 16 without the snowshoe.
Figure 19B:
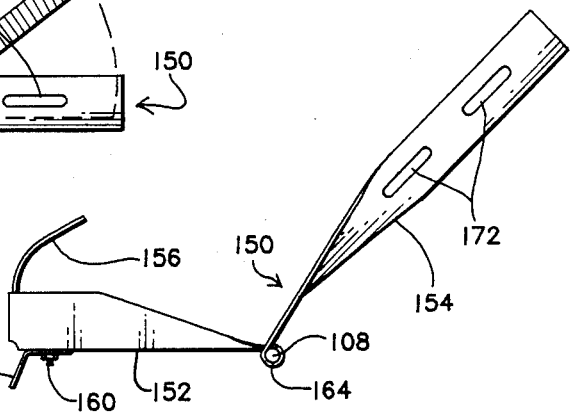

The heel portion 154, includes, as does foot plate 99 of FIG. 3, two side rails which define a region which is slightly wider than the sole of the heel portion of a running shoe to prevent lateral movement of the heel of the running shoe. Each of the side rails defines a pair of slots 172 through which strap 166 is selectively passed. The articulation of foot plate 150 is achieved by forming a hinge 162 in the center of the back of the toe portion 152 as shown in FIGS. 16 and 17. The hinge is formed by rolling that back edge of toe portion 152 with an inside diameter which is approximately equal to the diameter of pivot pin 108. Similarly, the front edge of heel portion 154 is bifurcated to fit on either side of hinge 162 of the toe portion 152, with each of those bifurcated portions being rolled to form hinges 164 also having an inside diameter which is approximately equal in diameter to the diameter of pivot pin 108. As a result of this hinged construction, the upward travel of the heel portion 154 forms an angle with the toe portion 152. (See FIG. 19*b*).

Articulated foot plate 150 is attached to snowshoe 100 by placing the hinges 162 and 164 of toe and heel portions 152 and 154 within toe hole 122 in alignment with snowshoe bushing holes 127. Then, pivot pin 108 is inserted from one side of snowshoe 100, through a first one of bushing holes 127, into one side of hinge 164, then into hinge 162, followed by the second side of hinge 164, and then the second bushing hole 127 on the far side of snowshoe 100.

To attach foot plate 150 to a running shoe 173, the runner inserts his foot as far forward as possible into, and beneath toe clip 156 of, the toe portion 152. Then, strap 166 is fastened over the instep of the foot and behind the heel of the running shoe at substantially the top edge of the heel of the running shoe 173 by slipping the tongue 168 into receptor 170 where it clips in place to hold the toe of running shoe 173 within the toe clip 156 as in FIG. 19*a*. The two-piece fastener shown in FIG. 16 can be of any design, for example the fastener disclosed in U.S. Pat. No. 3,798,711. The length of strap 166 can be adjusted at either end where it attaches to the two fastener pieces, or by threading strap 166 through another pair of slots 172 either further forward or backward as the situation requires.

While there has been shown and described the preferred embodiments of the present invention, it will be apparent to those skilled in the art that many changes and modifications made without departing from the invention in its broader aspects. Therefore, the appended claims are intended to cover all such modifications and changes that fall within the true spirit and scope of the invention.

What is claimed is:

1. Apparatus for attachment to a shoe, a boot, or the like of various sizes, said apparatus comprising:

foot plate means for receiving the sole portion of the boot, said foot plate means including:

a toe portion for receiving the toe portion of the boot; and a heel portion defining a substantially flat channel for receiving the heel portion of the boot, said heel portion having two sides, and front and tail ends, said heel portion along its front end being couplable with the toe portion, said tail end being in the same plane as said substantially flat channel, and at least a portion of each of said two sides extending upward parallel to each other to form side rail means along each side of the substantially flat channel thereof and defining a plurality of uniformly sized holes therein;

a non-metallic resilient arcuate strip affixed to and extending substantially vertically up from the forward edge of the toe portion of the foot plate means to limit forward and lateral displacement of the toe of the boot;

a non-metallic resilient loop affixed to the toe end of the toe portion of the foot plate means disposed to extended around the toe end of the boot to restrain vertical displacement of the toe of the boot;

a substantially U shaped bail having each end removably captured within adjacent holes in each of the side rail means to provide adjustability for various boot types and sizes; and lever means mounted centrally on the bail and defining a mating edge for compressively mating with the rear portion of the boot to apply forward and downward pressure thereto to maintain the toe of the boot in contact with said non-metallic resilient strip.

2. Apparatus as in claim 1 wherein said non-metallic resilient loop includes non-metallic adjustment means to size said loop to the users boot.

3. Apparatus as in claim 1 further comprising toe crampon means having toothlike projections extending therefrom for fitting substantially against the sole of said boot and engaging the surface being traversed.

4. Apparatus as in claim 1 further comprising heel crampon means having sharpened projections coupled to the heel portion of the foot plate means for abutting against the heel portion of said boot and engaging the surface being traversed.

5. Apparatus as in claim 4 wherein said heel crampon means includes a substantially U shaped channel dimensioned to fit beneath the heel portion of the foot plate means and having sides which extend upward juxtaposed the side rail means for attachment thereto, and having sharpened projections extending downward therefrom.

6. Apparatus as in claim 5 wherein said sides of the U shaped heel crampon means each define a plurality of holes sized and spaced to align with the holes in the side rail means.

7. Apparatus as in claim 1 further comprising an interlocking means for attaching the foot plate means to a snowshoe.

8. Apparatus as in claim 7 wherein said snowshoe comprises a large planar structure having an opening defined in substantially the central portion thereof, said foot plate means pivotally mounted to allow the toe portion of the foot plate means to extend through the opening when in use.

9. Apparatus as in claim 8 wherein:

said foot plate means includes a pivot pin means captured thereby for defining the axis around which the foot plate means pivots when in use; and said snowshoe includes bushing means disposed to receive the pivot pin means.

10. Apparatus as in claim 8 wherein:

said foot plate means includes pivot pin means releasably retained thereby for defining the axis around which the foot plate pivots when in use; and said snowshoe includes bushing means disposed to receive the pivot pin means.

11. Apparatus as in claim 10 wherein said pivot pin means includes:

a pair of pins dimensioned to extend through the bushing means and extend into said foot plate means; and a pair of spacers dimensioned to fit between the bushing means and the foot plate means with one of the pivot pins passing therethrough.

12. Apparatus as in claim 11 wherein:

said pivot pins and spacers each defining therein a lateral hole which are alignable when the foot plate means is mounted to the snowshoe; and said pivot pin means further includes a pair of retainer clip means having a shaft disposed for passing through the lateral holes of the pivot pin and spacer for locking the foot plate means to the snowshoe.

* * * * *